United States Patent [19]

Buchl

[11] Patent Number: 4,646,620

[45] Date of Patent: Mar. 3, 1987

[54] AUTOMATIC DEPTH CONTROL SYSTEM

[76] Inventor: Andrew F. Buchl, 401 9th Ave. SW., Rugby, N. Dak. 58368

[21] Appl. No.: 510,300

[22] Filed: Jul. 1, 1983

[51] Int. Cl.[4] ..... F01B 25/26

[52] U.S. Cl. ..... 91/1; 91/361; 91/367; 91/445; 92/13.1; 172/4

[58] Field of Search ..... 91/361, 367, 445, 1, 91/171, 520, 443, 463; 92/13.1; 60/546, 579, 583; 137/512, 599; 172/4

[56] References Cited

U.S. PATENT DOCUMENTS

| | | | |
|---|---|---|---|
| 2,755,721 | 7/1956 | Rusconi | 172/4 |
| 3,727,517 | 4/1973 | Slavin | 91/361 |
| 3,768,367 | 10/1973 | Fuzzell | 91/361 |
| 3,945,299 | 3/1976 | Fritz | 91/367 |
| 4,176,721 | 12/1979 | Poggemiller | 172/4 |
| 4,355,688 | 10/1982 | Hamm | 172/4 |
| 4,423,664 | 1/1984 | Buchl | 91/1 |
| 4,445,421 | 5/1984 | Walker | 91/361 |
| 4,529,039 | 7/1985 | Sakundiak | 172/4 |

*Primary Examiner*—Abraham Hershkovitz
*Attorney, Agent, or Firm*—Merchant, Gould, Smith, Edell, Welter & Schmidt

[57] ABSTRACT

An automatic depth control system is disclosed. The system includes a floating piston hydraulic cylinder in which the floating piston is adjusted as a stop for limiting the travel of the main piston in the cylinder. A depth sensing system is provided to sense the actual depth of a implement tool on which the cylinder is mounted to provide a depth signal indicative of the depth penetration of the tool. A circuit system is provided to receive the depth signal and to control a hydraulic valve system to move the stop piston within the cylinder to adjust the working position of the implement tool. The control system includes an instrument panel having a first display indicating the actual depth of the implement tool and a second display indicating the depth limit settings predetermined by the operator. Further means are provided to monitor the actual depth and compare it to the selected depth setting and thereby correct the position of the floating piston.

7 Claims, 13 Drawing Figures

63
62
36
64
83
25
66
69
20
82
0
1
2
3
4
5
6
7
8
73
74
68
72
83
70
16
81
18
80
22

36
62
83
64
39
38
20
82
17
60
53
61
26
25
16
74
44
24
70
72
46
38
33
52
50
56
32
51
48
50a
49
81
80
58
18
22

AUTOMATIC DEPTH CONTROL SYSTEM

TECHNICAL FIELD OF THE INVENTION

This invention relates generally to fluid cylinder control systems which allow for automatic control of piston strokes position, which in turn translates to depth control when used to raise and lower implements.

BACKGROUND OF THE INVENTION

In the manipulation of machinery, particularly farm implements, it is often necessary to hydraulically raise and lower the machinery repeatedly and reliably to preset positions. In the case of farm equipment, for example, it may be necessary for a tractor operator to lower a plow or other implement to a particular position so as to plow land to a desired depth. This depth may change according to varying requirements furrow to furrow or field to field and it is therefore necessary that the operator have the ability to change this depth with ease. Furthermore, it may be necessary to frequently raise the implement off the ground, for example when turning at the end of the field or for maintenance, and then return the implement to the proper depth setting.

In the prior art, the typical system used for this task includes a hydraulic cylinder connected between the implement frame, which is suspended over the ground with wheels, and the implement tool which is pivotally mounted to the frame. Thus, the relative positions of the frame and tool may be varied hydraulically utilizing standard tractor hydraulic systems. While in this manner an implement tool may be raised and lowered, it cannot be accurately positioned nor reliably maintained in a desired position due to, among other things, leaky valves and hoses and the high volume fluid flow rates typical of tractor systems, which make fine adjustments in piston position extremely difficult. Accordingly, devices independent of the standard control valves provided on the tractor have been employed in connection with the cylinders to enable an operator to accurately set a desired piston position.

One simple device used for this purpose is a ring which may be clamped around the piston rod to stop the stroke and thereby the implement tool at the desired working position. Another relatively simple device utilized is a poppet valve mounted on the cylinder and actuated by means attached to the rod to shut off hydraulic fluid flow to an appropriate cylinder chamber and stop the stroke when the working position is reached. Neither of these devices, however, can be remotely reset or adjusted and therefore the operator must stop the tractor and do so manually. If all fields were table top flat and of consistent soil composition, these systems would be somewhat adequate. Unfortunately, grade and composition often vary from one end of the field to the other, and to achieve uniform optimum implement penetration requires repeated manual readjustments.

Obviously, optimum soil penetration or working depth is often sacrificed for speed when stroke limiting systems of the above described type are employed. The result is reduced yield and unnecessary erosion, which is perhaps the foremost problem of today's farming industry. Therefore, it may be seen that better control of penetration depth can more than relieve inconvenience or inefficiency of equipment operation, but can provide improvements in both yield maximization and soil conservation. Thus, efforts have been and continue to be made to develop depth control systems in which, at least, depth settings may be manually controlled or adjusted from the tractor cab while on the go.

The above-described mechanical or manually adjusted systems offer the ability to control the relative positions of the implement frame and implement tool. However, the more important aspect of tillage implement control relates to the desirability of controlling the "actual" soil penetration depth of the implement tool, which as one skilled in the art knows, is not the same as controlling the relative positions of the implement frame and tool. For example, when passing from hard to soft soil the wheels of the frame sink further into the ground, and so too does the tool. Therefore, it is necessary to adjust the relative position of the frame and tool to position the tool at the desired depth. Thus, it will be seen that presetting the stop or working position of the piston only guarantees the tool's position relative to the frame and does not guarantee the actual position of the tool relative to the earth's surface. Accordingly, depth sensors have been developed to monitor the actual depth of the tool and provide a signal to the cab of the tractor so that the operator may at least stop and readjust the relative positions of the tool and frame and accordingly the depth of the tool's penetration. While this method of control provides a means to improve uniformity of tillage it nevertheless requires the operator to pay close attention to the monitor signal and manually correct deviations from the desired position. However, depth sensors have provided a vehicle to permit automation of depth control.

The conventional automatic system in use today consists of a single-piston and cylinder arrangement employing feedback from the depth sensor to control solenoid actuated valves for directing fluid into and out of the cylinder chambers. In these systems the desired working depth is preset remotely (for example in the cab) via an electrical circuit, the setting of which is constantly compared against the actual depth of the implement tool to generate an adjustment signal which controls and hydraulic fluid flow to the cylinder. Typically, proportional or "analog" feedback is employed so that the magnitude of adjustment fluid flow is commensurate with the degree of adjustment required. However, systems of this nature typically lack the measure of reliability and repairability that farming demands. More specifically, most, if not all of these systems utilize precision variable flow valves such as flow dividers to control the flow of fluid to the cylinder. While satisfactorily operative in the laboratory where their position may be accurately controlled, they are notoriously unreliable in the field, in which they are often subjected to harsh environmental conditions which can easily degrade or interrupt their operation. Furthermore, they are expensive and relatively difficult to replace or repair, and to some extent suffer from susceptability to overheating, as they depend on constant readjustments to compensate for leakage. Due to the remote location of most farms, it is not now uncommon for a farmer to lose one or more days of precious time waiting for the skilled technicians often needed to effect repairs.

Thus, notwithstanding the best efforts of many, there remains a need for more reliable depth control systems for tillage implements. As will be seen from the following the present invention provides a relatively simple and inexpensive automatic actual-depth control system for tillage implements characterized by high reliability and ease of repairability.

SUMMARY OF THE INVENTION

One aspect of the present invention relates to a hydraulic system having a hydraulic cylinder with a main piston for raising and lowering equipment and a floating piston for limiting the travel of the main piston. The postion of the floating piston is adjusted by admitting and draining fluid into the cylinder. Also included is one way check-valve means connected to the cylinder to positively control the admission and drainage of fluid therein, thereby preventing the position of the floating piston from drifting. In accordance with another aspect of the invention, there is described a system for indicating the position of a piston within a hydraulic cylinder and a system for monitoring the actual position of the implement tool with respect to the soil surface.

According to a further aspect of the invention, there is described a hydraulic system having a main cylinder, a floating piston, check valve means for controlling the passage of fluid into and out of the cylinder, and control valve means for directing the flow fluid into various portions of the cylinder, in response to a signal indicative of the actual position of the tool and a signal generated by a user set control circuit for designating the desired actual working position causing the piston to move in a desired manner.

According to still another aspect of the invention automatic control of implement working position is effected with highly reliable and self-cleaning fixed-flow checkvalves actuated in a "digital" manner much less subject to difficulties associated with maintaining variable-flow or analog fluid system precision. According to yet another aspect of the invention there is provided a backup manual mode of operation independent of the automatic control for increased reliability.

Thus there have been outlined rather broadly the more important features of the invention in order that the detailed description thereof may be better understood, and in order that the present contribution to the art may be better appreciated. There are, of course, additional features of the invention that will be described hereinafter and will form the subject matter of the claims appended hereto. Those skilled in the art will appreciate that the conception on which the disclosure is based may readily be utilized as a basis for the designing of other structures for carrying out the invention. It is important, therefore, that the claims be regarded as including such equivalent structures as do not depart from the spirit and scope of the invention.

DETAILED DESCRIPTION OF THE INVENTION

Figure 1:
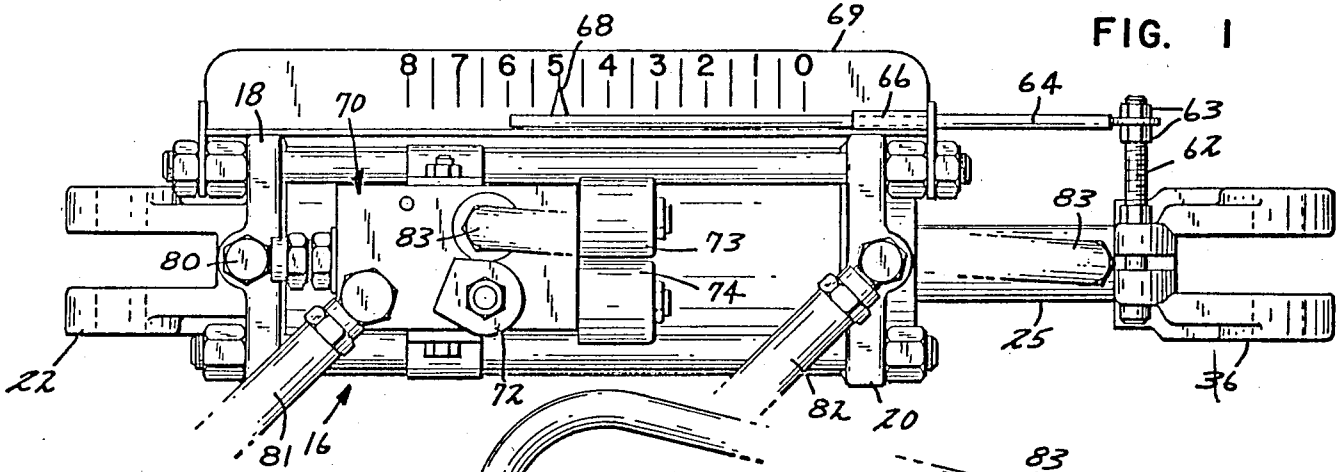
FIG. 1 is a top plan view of an electro-hydraulic depth control cylinder according to the present invention.
Figure 2:
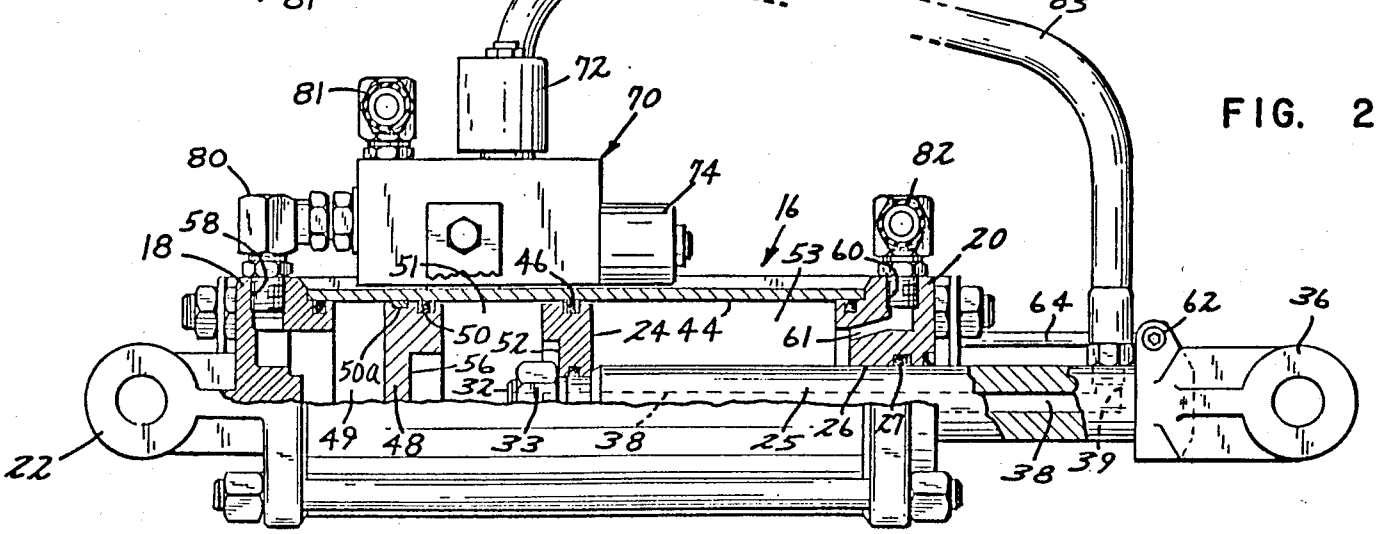
FIG. 2 is a side elevation with portions being broken away and shown in section.
Figure 3:
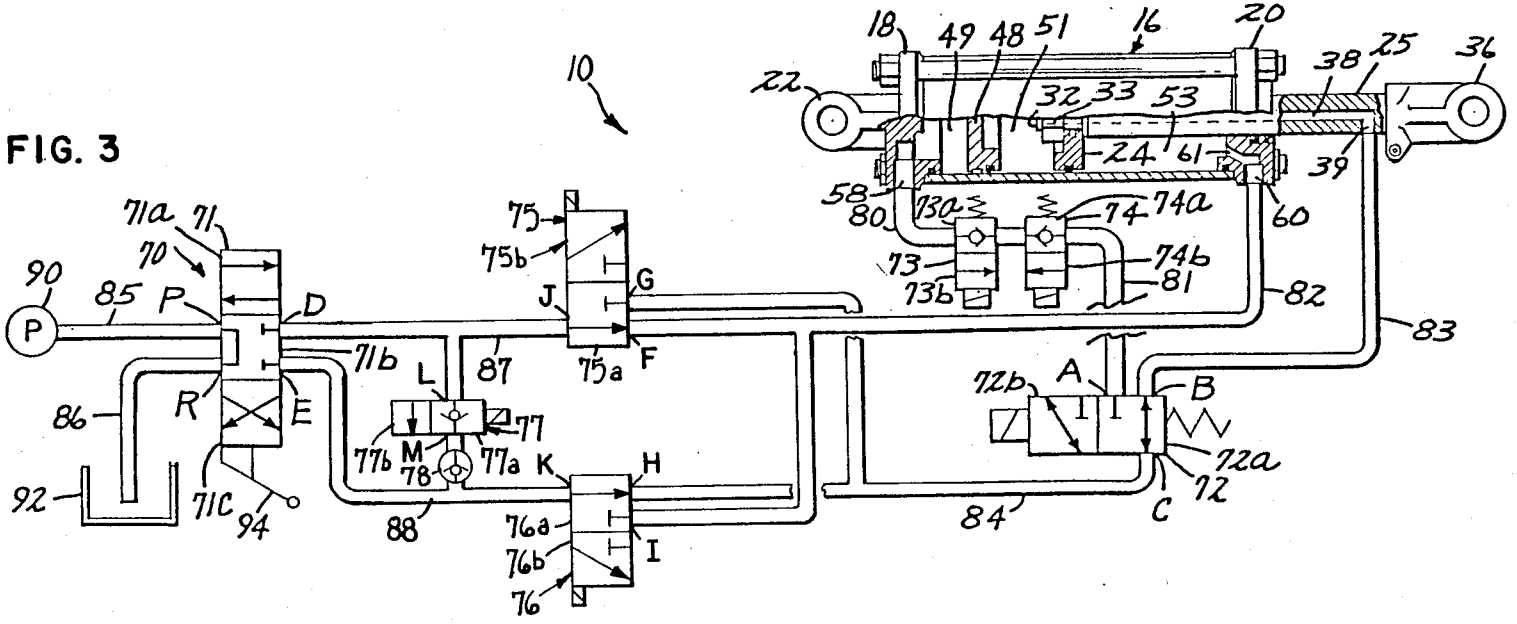
FIG. 3 is a schematic diagram showing an application of the cylinder of FIGS. 1 and 2 in a depth control system according to the present invention.

Referring to FIGS. 1 and 2 of the drawings, there can be seen an embodiment of the electro-hydraulic depth control cylinder hereinafter referred to as the EDC cylinder preferably utilized in the automatic system of the present invention. The overall hookup of the cylinder is shown in FIG. 3 in schematic form.

FIG. 2 shows the remotely controllable adjustable stroke fluid EDC cylinder 16 having opposite end walls 18 and 20. End wall 18 has a clevis-type projection 22 for attachment of the cylinder to an apparatus or implement to be moved. A main piston 24 is attached to stem 25 which slidably extends through opening 26 in end wall 20. A seal 27 prevents leakage of fluid along stem 25 past wall 20. Stem 25 has a threaded end 32 which, by means of nut 33, affixes the stem to main piston 24. The exterior end of stem 25 has a clevis-like attaching element 36 similar to that element 22. An elongated passage 38 is formed in stem 25 and extends between threaded end 32 and a point proximate clevis element 36 where the passage follows a right-angle bend and appears as an aperture 39 on the outer surface of the stem.

Piston 24 engages inner surface 44 of the cylinder 16 and has a seal 46 for preventing passage of fluid thereby. Floating stop piston 48 is provided in the space between piston 24 and end 18 and also slidably engages inner surface 44 and has seals 50 and 58. The surfaces of pistons 24 and 28 have annular recesses 52 and 56.

The region between cylinder 48 and end wall 18 is indicated by numeral 49, the second region between piston 48 and 24 is indicated by numeral 51, and the remaining region between end wall 20 and piston 24 is indicated by numeral 53.

An aperture 58 in cylinder 16 communicates with region 49 while aperture 60 through passageway 61 communicates with region 53. Aperture 39 in passage 38 permits communication with region 51. Ports 39, 58, and 60 are connected to control means indicated generally by the numeral 70 (shown in FIG. 3).

In the embodiment of the EDC cylinder shown in FIG. 1, integral indicator means are provided. Extending generally perpendicularly from clevis element 36 is threaded member 62. Extending generally perpendicularly from member 62 is shaft 64, which is affixed to member 62 by nuts 63. Shaft 64 extends through a tubular guide element 66 and has a pointer 68 attached to shaft 64 proximate its distant end. Scale plate 69 is affixed to cylinder 16 in such a manner that pointer 68 will indicate the relative position of stem 25 and likewise piston 24 by the location of pointer 68.

Figure 5:
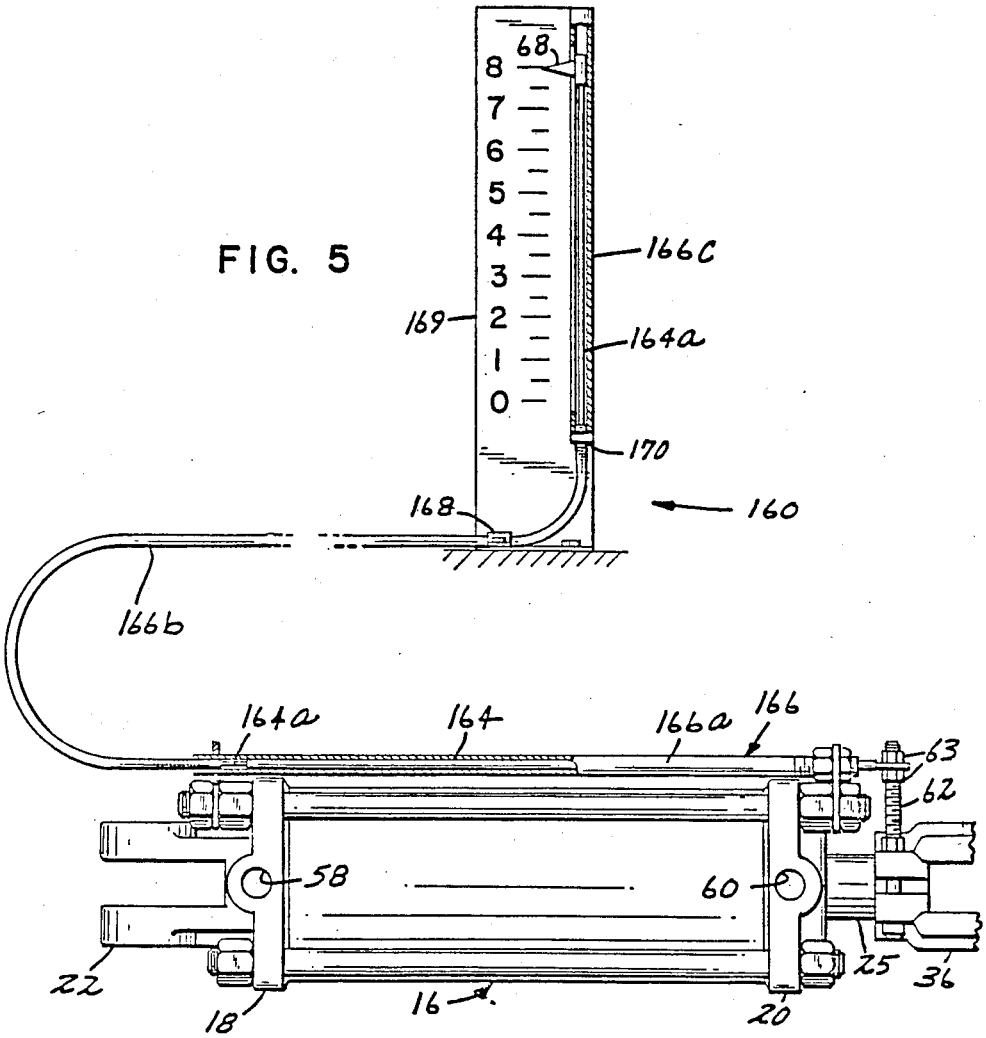
FIG. 5 shows an embodiment alternate to that of FIG. 1 having a remote indicating display.

FIG. 5 illustrates an alternate embodiment of the indicating means. In this figure, the position of stem 25 and piston 24 may be read by remote indicating means 160. To the extent this embodiment is described in the previous discussion, those elements will not be repeated. Replacing shaft 64 in the previous embodiment is stem 164, which extends into portion 166*a* of a tubular member 166. Portion 166*a* is sized to receive stem 164. Tubular member 166*a* is affixed to cylinder 116 at ends 18 and 20. Shaft 164 includes a portion 164*a* which is preferably made of flexible material, as is at least portion 166*b* of tubular member 166 so that the shaft can transmit information to the indicating means 160 around curves, etc. Preferably, tubular member 166*b* is formed of wire wound in a helical formation having aperture sized to receive portion 164*a*. The end of tubular member 166*b* is affixed at point 168 to graduated scale 169 and at point 170 to a rigid portion 166*c* carried by scale 169. A pointer 68 is attached to shaft 164*a* proximate its distant end allowing relative readings to be made on graduated scale 169.

Turning to FIG. 3, the valve system 70 is shown in schematic form as comprising valves 71, 72, 75, 76 and one-way check valves 73 and 74. Valve 71 may be the tractor selective control valve typically found as an integral part of modern tractors. The valves are hooked up as follows: conduit 80 connects aperture 58 to a series combination of check valves 73 and 74. Conduit 81 connects check valve 74 to valve 72 at connection A. Aperture 60 is connected to valve 75 at point F and valve 76 at point I by conduit 82. Aperture 39 is connected to point B on valve 72 by conduit 83. Point C on valve 72 is connected to point G on valve 75 and a point H on valve 76 by conduit 84. Conduit 87 connects point J of valve 75 to point D of valve 71. Conduit 88 connects point K of valve 76 to point E of valve 71. Conduit 85 connects point P on valve 71 to pump 90, and point R is connected to reservoir 92 by conduit 86. All conduits except 83 are preferably made of steel or copper to prevent leakage. Conduit 83 must be made of flexible material to accommodate movement of stem 25.

A solenoid controlled one way check valve 77 and one way valve 78 are connected in series between conduits 87 and 88. Position 77*a* blocks point L while position 77*b* connects point L to point M allowing fluid to flow from conduit 87 to conduit 88. One way valve 78 prevents flow from conduit 88 toward conduit 87.

Valve 71 is shown in schematic form having three positions indicted by boxes 71*a*, 71*b*, and 71*c* selectable by means 94. Box 71*a* indicates the fluid connection between points "P and D" and "R and E". Box 71*b* indicates the connection of points P and R, which merely connects the pump to the reservoir when the system is on standby. Box 71*c* shows the fluid connection of point "P and E" and "R and D".

Valves 75 and 76 have two positions shown by boxes 75*a* and 75*b* and 76*a* and 76*b* respectively. Box 75*b* indicates a connection between points J and G and while point F is blocked and box 75*a* a connection between points J and F while points G is blocked. For valve 76 box 76*a* indicates a connection between points K and H while point I is blocked and box 76*b* between points K and I while point H is blocked.

Valve 72 has two positions shown by Boxes 72*a*, 72*b*. Box 72*a* indicates the connection of points B and C while point A is blocked. Box 72*b* indicates the connection of points A and C while point B is blocked.

Check valve 73 is a one-way check valve, having two positions 73*a* and 73*b*, 73*a* being the check position preventing flow from aperture 58 and 73*b* being the disable or bypass condition which allows such flow. One valve found effective for use in this application is a no-drip, low-leakage needle-type check valve, having restricted flow. This flow restriction has been found to effect self-cleaning and help control adjustment response time. Similarly, check valve 74, having two positions 74*a* and 74*b*, provides the same function as check valve 73 except in the opposite direction. The check valves 73 and 74 provide a positive lock against leakage therethrough so that the floating piston will not drift in either direction. Therefore, once the working piston position is set chamber 49 is isolated from the remaining valves and conduits in the system so that leakage associated therewith has no effect on the set position of piston 48 nor the operative working position of piston 24 and rod 25. Accordingly, as may be readily seen, readjustments to compensate for leaking valves or the like is eliminated. In the preferred embodiment valves 73 and 74 are always operated simultaneously; however, it is only necessary to operate one at a time depending on the direction of flow desired. Also, it is possible to vary the aperture size of check valves 73 and 74 according to the bore of the cylinder for example, to control depth adjustment rate.

Figure 11:
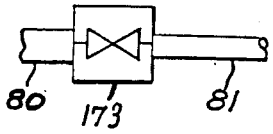
FIG. 11 is a plan view of an alternate check valve for use in the present invention.

As an alternative to check valves 73 and 74, it is possible to substitute a simple manually operated positive fueling valve 173 to replace check valves 73 and 74 as shown in FIG. 11.

OPERATION

The operation of the system of FIG. 3 in the manual mode is explained as follows. In standby operation, pump 90 may by shut off or in the case of a continuous pumping system, position 71*b* of valve 71 can be selected so that the pump will charge into the reservoir.

Assuming now that valves 75, 76 and 77 are all in position a, the following operation results. To move piston 24 and stem 25 out of cylinder 16, position 71*c* on valve 71 is selected simultaneously with position 72*a* on valve 72, while the check valves are in position 73*a* and 74*a*, thus blocking flow through conduit 80, 81. This circuit is indicated at Branch P5 of circuit 360 in FIG. 8. With the valves in the above-indicated positions, fluid will flow into aperture 39, filling region 51 with fluid, thereby causing region 53 to decrease in space and driving fluid through aperture 60 into reservoir 92. Floating piston 48 will not move because conduit 81 is terminated by a blocking seal at point A, and to further ensure against any leakage, check valves 73 and 74 prevent fluid flow in either direction, so that fluid may neither leak from chamber nor be drawn into the chamber.

Figure 8:
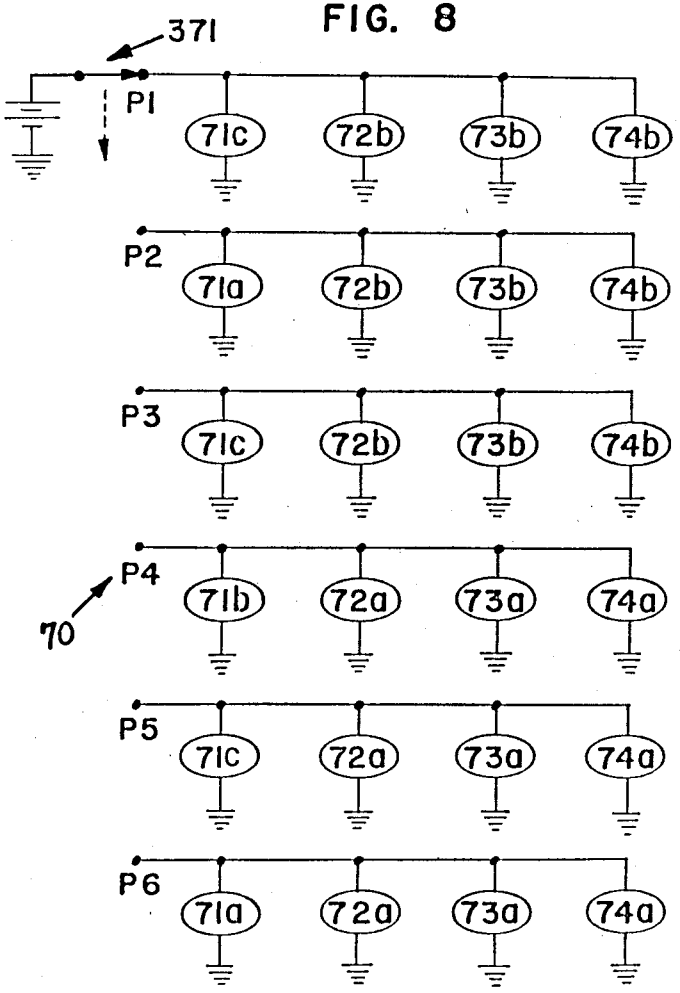
FIG. 8 is a schematic circuit of a preferred electrical connection of valves in FIG. 6.

Likewise, main piston 24 can be moved toward end 18 by the arrangement shown in branch P6, FIG. 8, i.e., activation of 71*a*, 72*a*, 73, 74*a*.

To move both pistons 24 and 48 and stem 25 inwardly (i.e., toward end 18), positions 71*a*, 72*b*, 73*b*, and 74*b* are selected on the appropriate valves. (See Branch P2 in FIG. 8). This allows fluid to be transmitted from pump 90 into aperture 60, which causes region 53 to expand, thereby driving fluid through conduit 38 and out aperture 39 and into reservoir 92. Likewise, both pistons can be moved toward end 20 (i.e., right) by the selection of valve 71*c*, 72*b*, 73*b* and 74*b* as shown in Branch P1, FIG. 8.

To move floating stop piston 48 it is desirable to reduce the size of region 51 to a minimum (i.e., to bring pistons 48 and 24 into abutment) so that it is possible to know the exact stroke of piston 24. This is particularly relevant when the indicator means are employed for indicating the exact position of the piston. Pistons 24 and 48 can be brought into abutment by moving piston 24 as explained above. Piston 48 may then be moved toward end 20 by selecting positions 71*c*, 72*b*, 73*b*, and 74*b* on the corresponding valves. This will permit a flow of fluid from pump 90 into aperture 58, causing region 49 to expand, which in turn will cause region 53 to decrease in size, driving fluid through aperture 60, which will be passed through valve 71 to the reservoir 92. (See Branch P3 in FIG. 8). Once this step has been completed, it may be desirable to return valve 74 to position 74*a* to totally prevent leakage in either direction.

To cause piston 48 to move toward end 18, positions 71*a*, 72*b*, 73*b* and 74*b* are selected. (See Branch P2 in FIG. 8). This will cause the flow of fluid form pump 90 into aperture 60, which will cause region 53 to expand, thereby decreasing the volume of region 49, which in turn drives fluid out of aperture 58 past the disabled check valve and into reservoir 92. Branch P4 with 71*b* selected is a standby position.

It should be noted that valves 71, 72, 73, and 74 may be mechanically or electromagnetically coupled so that a single selection of valve system 70 will cause all appropriate valves to be operated to perform a particular function. FIG. 8 illustrates a preferred circuit showing this interconnection. Valves 72, 73, and 74 are shown in their normal position under spring bias and include solenoids to move them to their activated position. Valve means 70 includes an electric switch 371 for controlling the solenoids and switch 71.

The preceding description of operation assumed valves 75, 76 and 77 to all be in position a. The following description of operation assumes valve 71 to be in position a, in effect removing the valve from the circuit. In this mode of operation valves 75, 76 and 77 may be selectively positioned by solenoid actuation to emulate the operative positions 71*a*, 71*b* and 71*c*, allowing total electrical control of all modes operating with valve 71 in position a or c, as indicated by P1, P2, P5 and P6 of FIG. 8. Specifically, positioning both valves 75 and 76 in position a allows operation as described with respect to valve 71 in position a, as for example illustrated in FIG. 8 and, positioning both valves 75 and 76 in position b allows operation as described with respect to valve 71 in position c. Thus, it will readily be seen that the operations designated by P1, P2, P5 and P6 may be accomplished either manually via valve 71 with valves 75 and 76 in position a or by electrical control via valves 75 and 76 with valve 71 in position a. Also, the neutral or idle operation of valve 71 designated by P4 may be emulated by valve 77 electrically except however a certain restriction in the valve may be provided so that a minimum positive pressure is maintained in conduit 82 and chamber 53, although this is not essential. In this manner excessive overheating of "closed" systems may be averted where the present invention is employed therewith. In "open" systems valves 77 and 78 may be omitted. Because, as will be seen, automatic depth control is effected via valves 75, 76, and 77, an emergency backup mode of operation in case of an electrical failure or malfunction in the automatic control system is provided via valve 71, thus substantially enhancing overall reliability of operation. In this manner tilling operation may continue by manual control of the valves while repair of the automatic system is accomplished.

Figure 4:
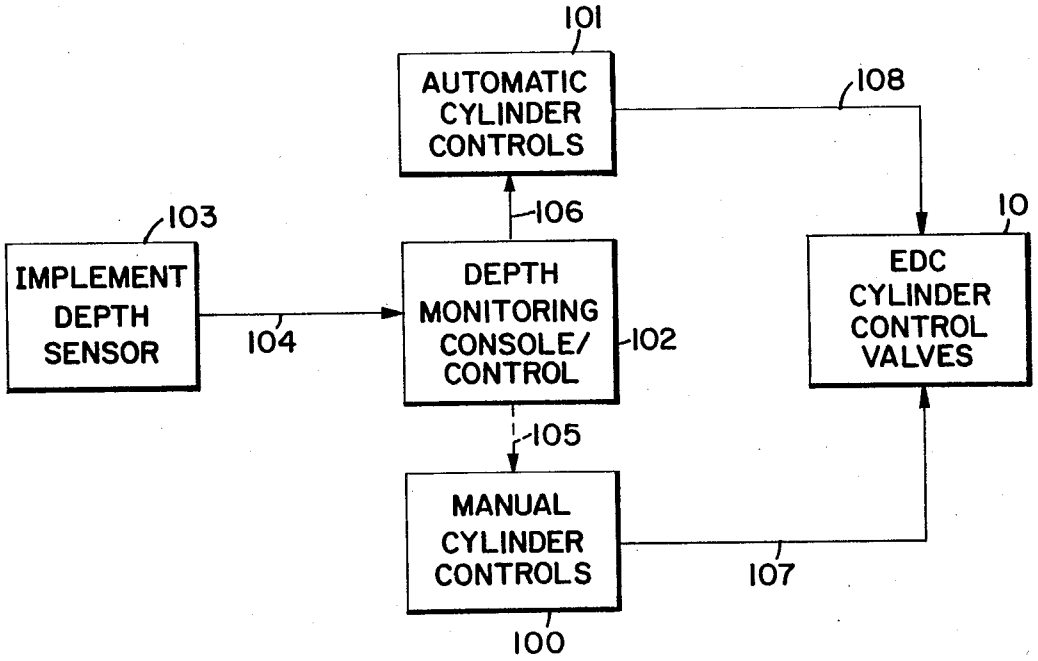
FIG. 4 is a functional block diagram of the overall configuration of the automatic depth control system of the present invention.

The overall connection of the EDC cylinder 10 and control valves 70 in the automatic depth control system of the present invention is illustrated in functional block diagrammatic form in FIG. 4. EDC cylinder 10 is connected for control by manual cylinder controls 100 or automatic cylinder controls 101 via signal paths 107 and 108, respectively. Manual cylinder controls 100 include valve 71, which is typically mechanically actuated by the lever 94, and manually activated control switches as for example explained with reference to FIG. 8, whereby the floating stop piston in EDC cylinder 16 may be manually adjusted to the desired position and whereby piston 24 and rod 25 may be extended or retracted to and from the up maintenance or transport position and the down working position. When EDC cylinder 10 is under manual control valves 75, 76 and 77 are all in position a, as biased resiliently in their relaxed condition.

When automatic control of EDC cylinder 10 is employed via automatic cylinder controls 101, depth monitoring console 102 (mounted on cab dash preferably) and implement depth sensor 103, valve 71 is placed in position 71*a* as accomplished through manual cylinder controls 100. In this mode of operation, electric signals indicative of the actual implement depth, are forwarded to the depth monitoring console 102 through a signal path 104. Console 102 receives the depth indicating signal to provide a visual readout in a bar graph format, which may be monitored by the operator, and to produce signals indicative of a necessary correction for input to automatic cylinder controls 101 via signal path 106. In the backup mode, automatic controls 101 may be disabled and the operator may accomplish adjustments via manual controls 100 as indicated by operator feedback path 105.

Figure 10:
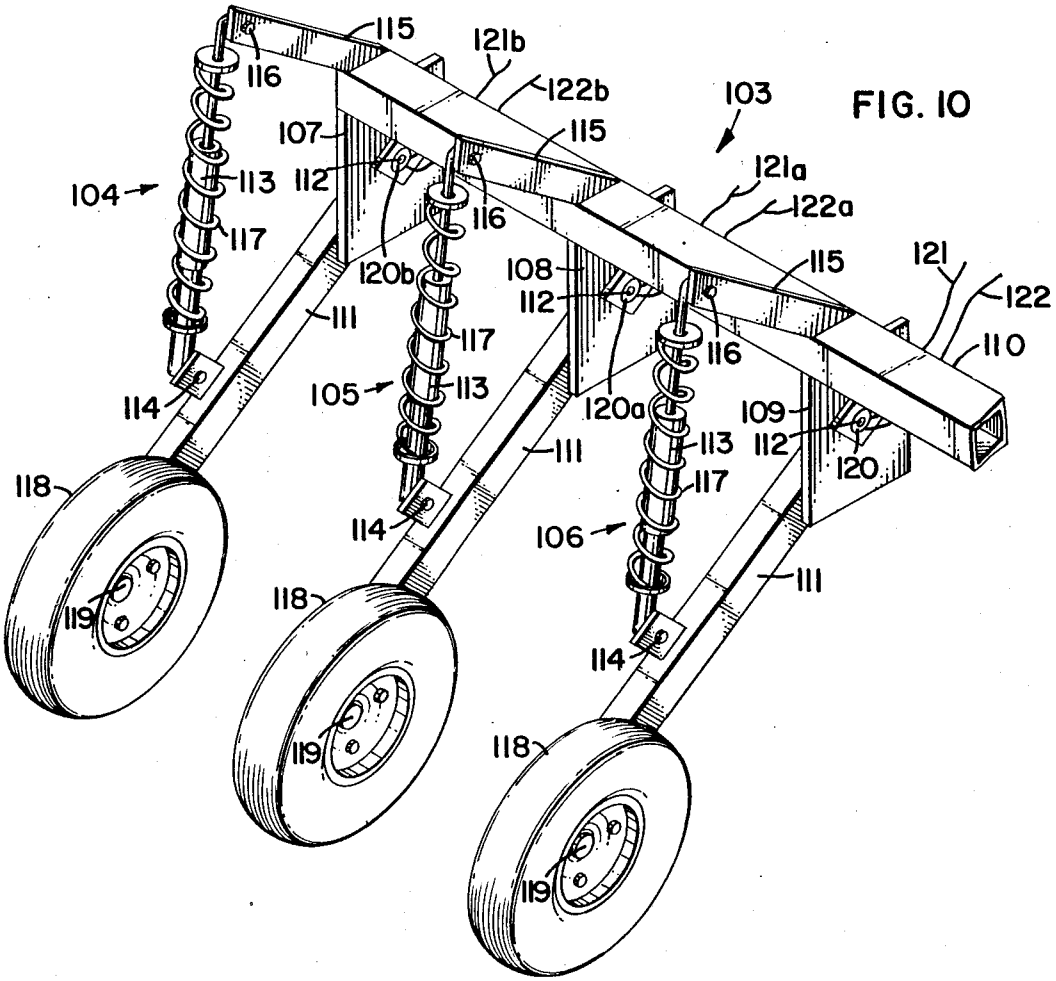
FIG. 10 is a perspective view of a depth sensing apparatus as preferably employed in the present invention.

Turning now to FIG. 10 there is shown an implement depth sensor 103 as preferably employed with the present invention. Sensor 103 includes three depth sensing assemblies 104, 105 and 106 each preferably connected to the front bar 110 of an implement frame in a trailing relationship therewith with mounting assemblies 107, 108 and 109. Preferably, assemblies 104–106 are mounted parallel to one another across the width of the implement on the right, left and center thereof. Each of assemblies 104–106 are identical and include, for example with respect to assembly 106, a beam 111 pivotably connected to the front bar 110 through an axle 112, a shock absorbing member 113 pivotably connected to beam 111 at bracket 114 and to strut 115 at point 116, a spring 117 for providing a slight downward bias between strut 115 and beam 111 and finally a gauge wheel 118 rotatably mounted on an axle 119. Preferably, wheel 118 is of a low pressure type. Bracket 114 is slotted so that its position on beam 111 may be adjusted. Axle 112 is fixed to beam 111 and pivots in a bearing in mounting assembly 109. A potentiometer 120 is also mounted to assembly 109 and has its wiper shaft connected to axle 112 so that the resistance thereof varies with the position of beam 111 as wheel 118 traverses a field surface. The wiper tap and another tap of potentiometer 120 are connected to signal carrying conductors 121 and 122 which are connected to the depth monitoring console 102 as functionally indicated by signal path 104 of FIG. 4. Although not explicitly described, it will be understood that assemblies 104 and 105 are identically constructed to assembly 106 to provide corresponding depth indicating signals to the console 102.

Figure 12:
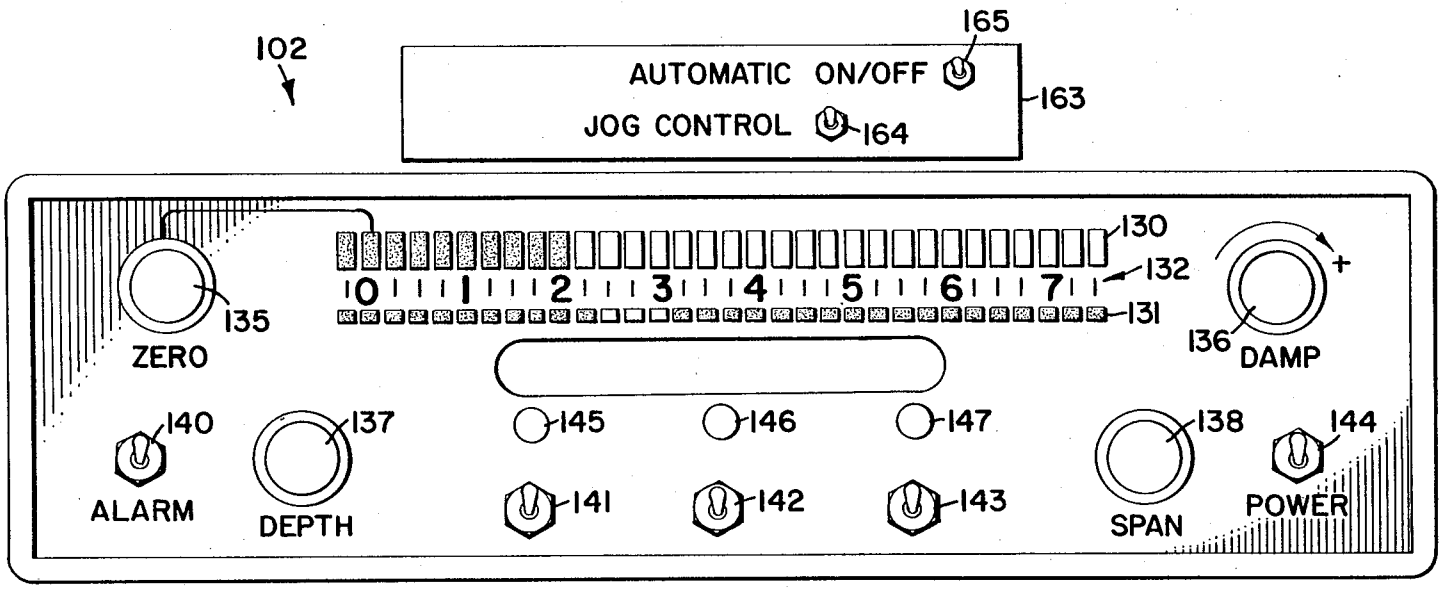
FIG. 12 is a view of the cab mounted control console according to the present invention.
Figure 13:
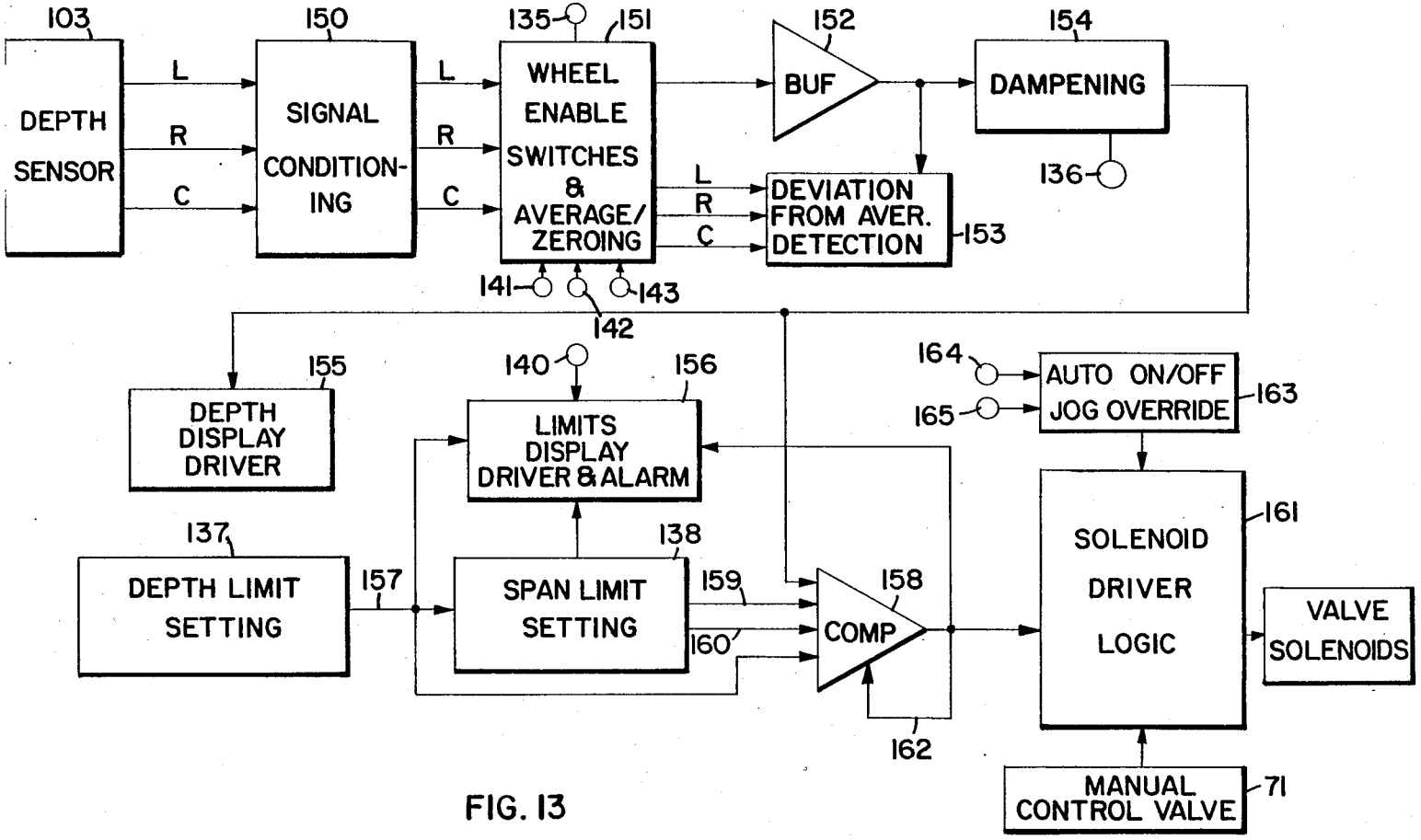
FIG. 13 is a functional block diagram of the console electronics of the present invention.

Referring now to FIGS. 12 and 13 the design and operation of console 102 will now be explained. In FIG. 13 depth sensor 103 provides three (left, right and center) signals indicative of the positions of wheel assemblies 104–106, variable resistivities in the present embodiment. It will be understood however that any other sensor producing an electrically compatable signal output could be employed. Each signal is conditioned by a circuit 150 to compensate for nonlinearities related to the angular nature of verticle displacements in the depth sensing assemblies. Circuit 151 receives the conditioned signals and provides means to zero the value of each when the implement tool is positioned at the soil surface, as provided by a zeroing potentiometer control 135 (FIG. 12). Circuit 151 further provides in operation an average of the selected inputs to a buffer 152. Switches are provided in circuit 151 so that any one of the three left, right, and center (L, R, C) depth indicating signals may be switched out of the circuit. Thus, each may be zeroed individually and depth readings may comprise any possible combination (i.e., one, two or three). These switches are illustrated in FIG. 12 as 141–143.

A circuit 153 receives the selected signals and compares the average thereof, as from buffer 152, against the individual magnitude of each. If any selected signal deviates more than a preset amount from the average a corresponding visual indicator 145–146 is energized and an audible alarm may be sounded. In this manner a clearly erroneous signal may be detected and switched out of the averaging circuit, thereby avoiding undesirable automatic depth settings, as for example may be caused by a flat depth tire.

A dampening circuit 154 is provided and receives the output of buffer 152 to dampen or filter out rapid fluctuations in depth signals as may be caused by rough terrain for example. The degree of dampening, and in turn the speed of response, may be adjusted according to desire via a potentiometer control 136. A depth display driver 155 receives the dampened signal and controls bar-graph 130 accordingly. The segments of bar-graph 130 are thereby selectively illuminated or energized to indicate depth penetration in inches as provided by a scale 132. A depth reading of 2 inches is illustrated by FIG. 2.

The desired depth limits may be set in limit display driver and alarm circuit 156 via potentiometer controls 137 and 138, with control 137 setting the shallow "depth" limit and control 138 setting the "span". Thus, any depth detected outside these limits will cause corrective action to be taken as will be hereinafter explained in more detail. As illustrated in FIG. 12 with respect to limit bar-graph 131 the shallow depth limit is set at 2 and $\frac{1}{4}$ inches while the deep limit is controlled at 3 and $\frac{1}{4}$ inches as provided by a span setting of $\frac{3}{4}$ inches. All segments of limits bar-graph 131 except those designating the permissible operating span are energized. One feature of the limit setting is that the "span" and "depth" may be set independently. In other words, altering the depth (i.e. shallow limit) automatically sets the deep limit in accordance with the offset specified via the span control, as indicated by signal path 157.

A comparator circuit 158 receives the shallow depth limit setting via signal path 157 and the deep limit setting via path 159 to compare depth readings outputted from circuit 154 there against. If the sensed depth is outside either limit an appropriate signal (i.e. indicating too-deep or too-shallow) is provided at the output of circuit 158 to cause appropriate corrective action to be effected by solenoid driver logic 161. This corrective action signal is further provided to circuit 156 to cause the segments corresponding to the side out of limit to flash on and off, allowing the operator to quickly ascertain the direction of depth deviation. Optionally, an alarm may also be sounded as controlled by a switch 140.

As illustrated, a second signal path 160 is provided from circuit 138 to comparator 158. This signal is approximately equal to the center or mid-point between the shallow and deep limit settings. Also, a signal path 162 feeds back into comparator 158. Signal path 162 is provided to latch or switch comparator circuit 158 into a corrective action mode wherein the designated (i.e. either shallow or deep as the deviation may be) limit is temporarily held at the center or mid-point so that to reset or clear the corrective action indicating output of circuit 158, the depth must be adjusted to the approximate midpoint of the designated limits. In this manner any corrective action taken results in an optimum midpoint recovery. For example, if depth were to deviate as illustrated in FIG. 12, the stop position of the cylinder would be adjusted until it resulted in a tool working depth reading of 2 and $\frac{3}{4}$ inches.

With respect to logic 161 it will be understood that the same causes, by any conventional electrical logic means, valves 72, 73, 74, 75, and 76 to operate as explained with reference to FIG. 8, P2 and P3 (with valve 71 in position a) according to the direction of correction required. When no correction is currently required the system is positioned as designated by P6 with valve 77 in position a where this valve is implemented for bypass.

To cause piston 24 and rod 25 to jog up and down as explained with reference to P5 and P6 of FIG. 8, as for example required while turning at the end of a field, a jog override circuit 163 is provided, and is activated by a panel switch 164. When activated, override circuit 163 overrides the automatic control signal from circuit 158 and causes piston 24 to be moved to end 20 of the cylinder 16, as hereinabove described with reference to P5. When deactivated the valves are energized as described with reference to P6 until the depth reads within limits, at which point automatic control resumes. It will be appreciated that full fluid flow in jog operation (as the restricted flow check valves are bypassed) allows quick retraction and deployment of the tool in this mode.

As indicated hereinabove automatic control may be deactivated completely as desire or need indicates, and switch 165 and circuit 163 are provided for this purpose. When in manual mode, valves 75, 76 and 77 remain in position a and control is effectived via valve 71 as hereinbefore described.

Although not explicitly illustrated, it will understood that power may be provided from the tractor electrical system and switched to the monitor console as provided by power switch 144.

Preliminary setup of the present system will now be briefly explained. First, the gauge wheels of assemblies 104–106 are adjusted via bracket 114, in a hold down position three inches or so before the ground working tools touch down. Preferably, set-up should occur on firm and level ground, with the implement sitting level. The working tools are then manually adjusted to just touch ground and then each sensor is individual zeroed as provided by switches 141–143 and zero pot 135. The operating depth limits are then set via pots 137 and 138 at which point automatic adjustment will ensue when the system is activated via switch 165.

While the present automatic system is preferably employed with a floating piston EDC cylinder, it may also be employed with a conventional single piston and cylinder arrangement. Referring to FIG. 3, the necessary modification will be explained. Removing stop piston 48 and sealing aperature 39 modifies cylinder 16 into a conventional single-piston and cylinder arrangement. The required plumbing modification to this conventional cylinder then involves simply connecting conduit 83 into conduit 80 with a "T" fitting, thus providing a bypass of flow lock valves 73 and 74 (these remain connected). With this modification the conventional single-piston cylinder may be operated in the same manner as explained with reference to the floating stop piston arrangement.

Figure 6:
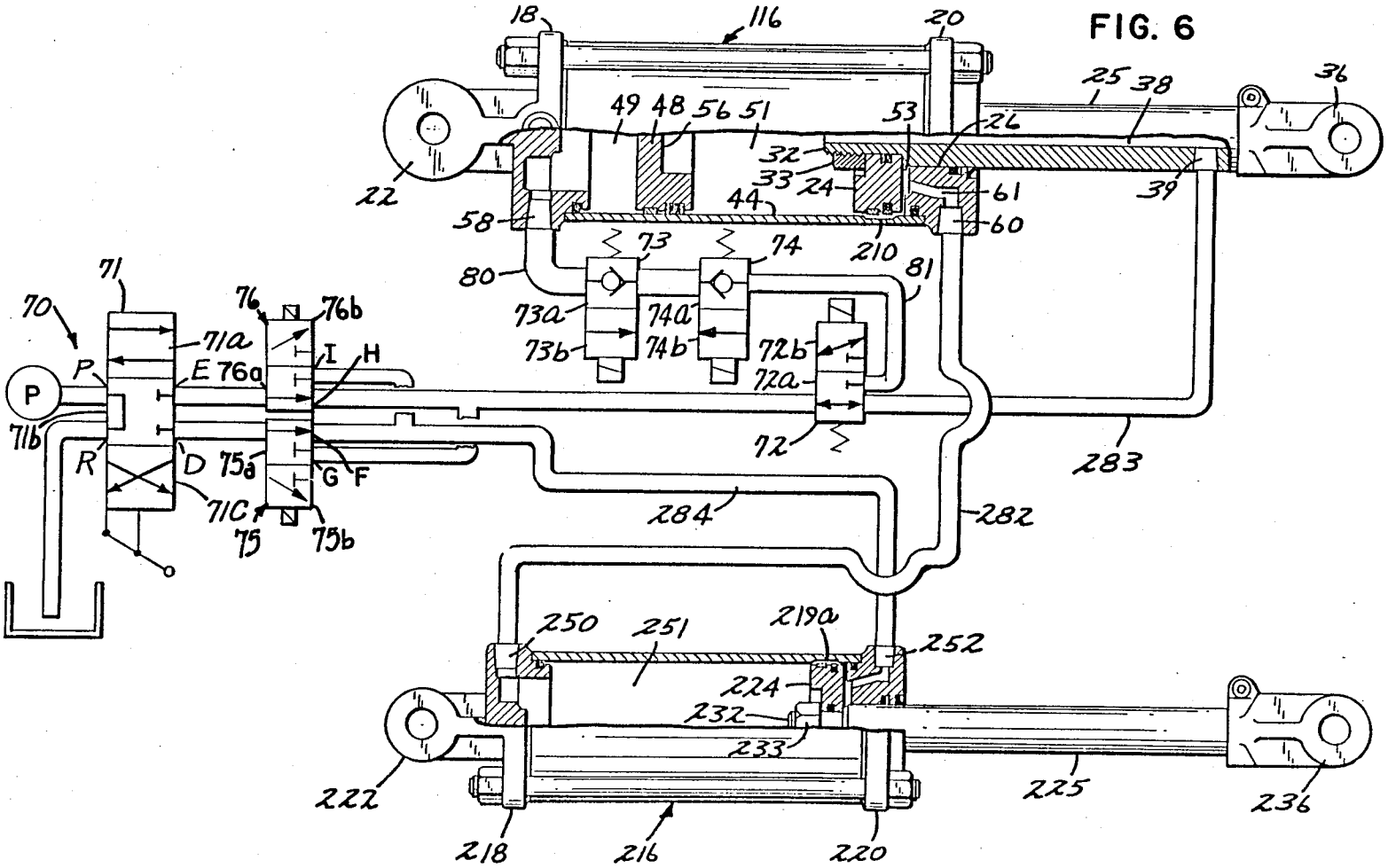
FIG. 6 is a schematic diagram of an alternate embodiment of the present invention.

A further alternative embodiment is shown in FIG. 6. This embodiment employs both master and slave cylinders. Again, to the extent this embodiment is similar to the previous embodiments, like numerals will be used and discussion of them should be had by reviewing the disclosure above. While the embodiment of FIG. 6 is shown without indicator means, it is understood that this aspect of the invention may be added as desired as shown in FIGS. 1 and 5.

With respect to main cylinder 116, it can be said that this element is substantially identical to that in the previous embodiment indicated by numeral 16 with the exception of an additional bypass located preferably on the interior surface of the cylinder wall. This bypass is formed as a depression or groove 210 which preferably covers only a portion of the circumference of the inner cylinder wall. This depression is located proximate end 20 and permits passage of fluid from region 51 to aperture 60 around main piston 24. The purpose of this bypass is to permit rephrasing or resynchronization of both the master and slave cylinders. The fluid paths created by conduits are substantially the same in FIG. 6 as in FIG. 3, with the exception that slave cylinder 216 is essentially connected in series with conduit 82. In FIG. 6, this is shown by numerals 282 and 284. Conduit 282 is connected to cylinder 216 at aperture 252 at one end and point D in valve 71, through valve 75, at the other end. Conduit 283 connects aperture 39 with point E on valve 71, through valve 72 and 76.

Slave cylinder 216 is structurally similar to cylinder 116 except floating piston 48 is not present. The volume of cylinder 216 is adjusted so that the travel of main piston 24 and 224 in the slave will be synchronized. No stop piston is necessary in the slave since its travel is entirely controlled by the master cylinder 116. As in cylinder 116, a depression 219*a* is formed in the inner surface of the cylinder wall to allow a bypass of fluid when piston 224 is in abutment with end 226*b* thereof and the stem 225 is fully extended.

Although not shown, it will be understood that valves 77 and 78 as shown in FIG. 3 may also be employed with this embodiment between valves 71 and 75 and 76.

OPERATION OF MASTER-SLAVE

Figure 9:
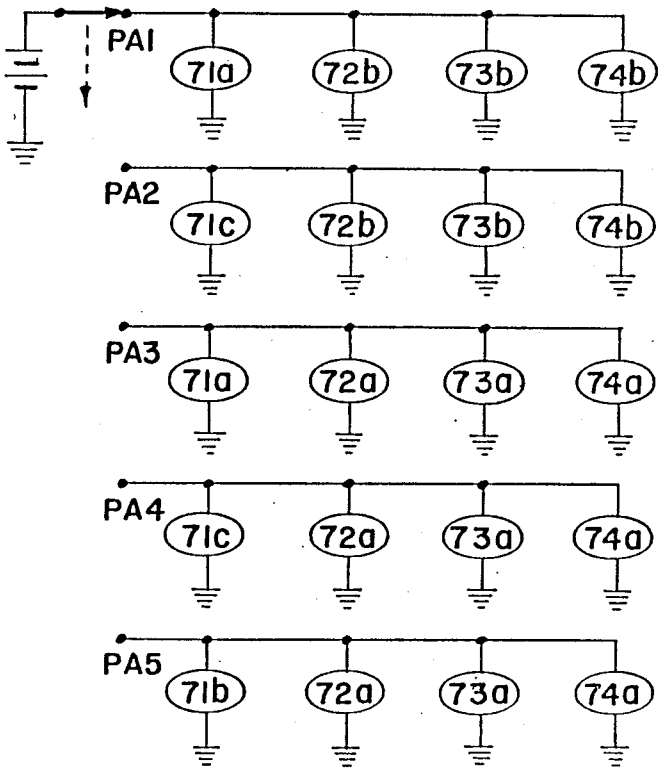
FIG. 9 is a schematic circuit of a preferred electrical connection of valves in FIG. 3.

The operation of the embodiment shown in FIG. 6 is similar to that of the embodiment in FIG. 3; however, the adjustment of the position of floating stop piston 48 is somewhat different due to the necessity of synchronizing or phasing both slave and master cylinders. FIG. 9 in the drawings is similar to FIG. 8 in showing the electrical connector of the circuit except that it pertains to this embodiment. Again, the valves are shown as biased in their "normal" position by springs and are moved to their activated position by solenoids.

To begin operation of this system, it is preferable to shift both main pistons 24 and 224 up against end members 20 and 220 respectively. Assuming that valves 75, 76 and 77 are in position a, this is accomplished by selecting the following valve positions: 71*a*, 72*b*, 73*a*, and 74*b* (Branch PA1 in FIG. 9). This arrangement will allow fluid to enter region 49 and cause region 51 to collapse as floating piston 48 comes into contact with piston 24. Fluid will escape around bypass 210 and out of aperture 60 where in turn it will fill region 251 in slave cylinder 216. When slave cylinder 216 is fully extended, bypass 219*a* will allow fluid to pass through to the reservoir 92.

The floating piston 48 may now be positioned by moving main piston 24 toward end 18 to the extend desired. This is accomplished by setting valves as follows: 71*c*, 72*b*, 73*b*, 74*b* (Branch PA2 in FIG. 9). Fluid will flow into aperture 252, causing slave piston 224 to compress region 251. There will be some loss of fluid around bypass 219*a*; however, this will be only momentary. The same compression will occur in main cylinder 116 and the fluid will exit aperture 58 on its way to reservoir 92. At the point at which the stroke length is to be set, one-way check valves 73 and 74 will be set to positions 73*a* and 74*a*, thereby locking the position of the floating stop piston 48. The location of the stop piston 48 will be apparent as the indicator scale 69, 169 which may be associated therewith. With floating stop piston 48 now set, it is possible to move the main piston toward end 20 involves setting the valves to positions 71*a*, 72*a* (while check valves 73 and 74 are closed; see PA3). Main pistons 24 and 224 will travel toward end 18 when valves 71*c* and 72*a* are selected (see Branch PA4). Standby, i.e. no movement, is shown as Branch PA5 in FIG. 9.

Figure 7:
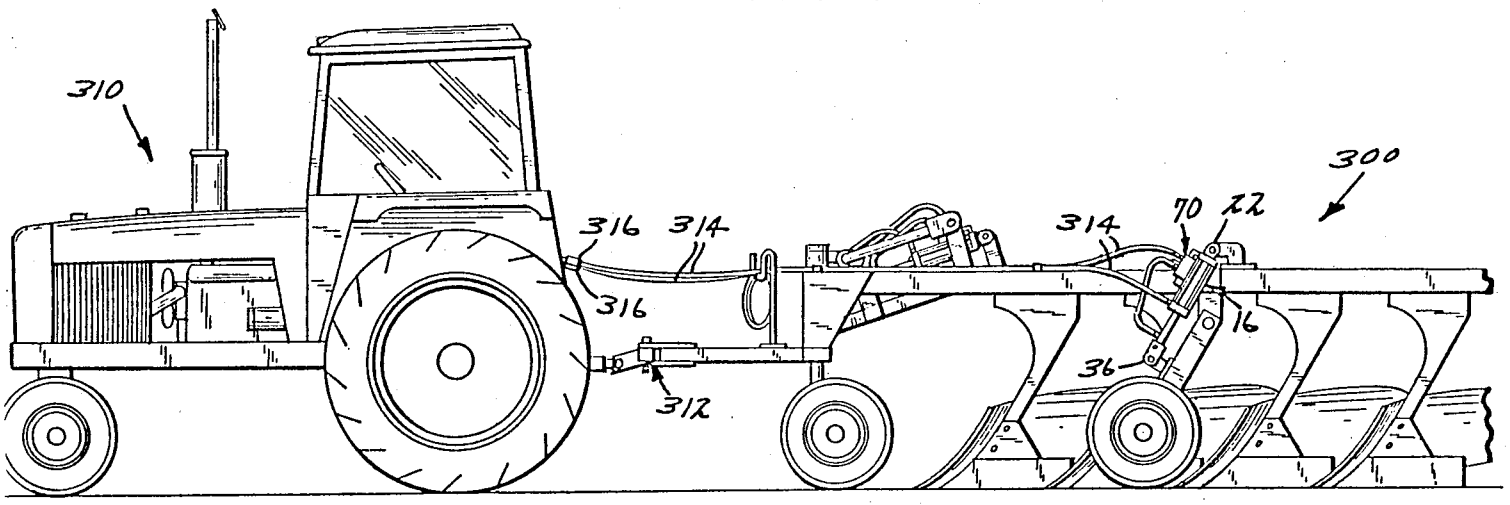
FIG. 7 is a side view of an embodiment of the present invention in use on a farm implement.

Like the operation of the embodiment of FIG. 3, the master-slave arrangement of FIG. 6 may also be operated utilizing electrically activated valves 75, 76, and 77 with valve 71 in position a. FIG. 7 illustrates a typical arrangement of the embodiment of the EDC cylinder as employed on a farm implement. The farm implement 300 is attached to the tractor 310 by linkage 312. The source of hydraulic fluid, in this case, is on the tractor and is connected to the hydraulic cylinder 16 through conduits 314. Conduits 314 have been disconnectable couplings 316. Typically disengagement of these couplings may be difficult and even dangerous if hydraulic fluid is under pressure therein. By means of valves 71 on the tractor and valves 73 and 74 on the implement, the couplings can be isolated from the pressure sources (i.e., the pump and the cylinder), making disconnection safe and easy while maintaining the fixed position of the pistons. Although not illustrated, it will be understood that sensor assemblies 104–106 would be deployed from the implement frame and electrically connected to the console 102.

It will now be seen that the invention provides an adjustable stroke power cylinder system where the stroke may be automatically adjusted by remote control means and the stroke length may be securely sealed through a positive sealing check valve. In addition, visual indicator means are provided to permit the operator to know with reliability the position of the pistons. It is understood that the system is equally applicable to pneumatic as well as hydraulic operation.

While there have been described above the principles of this invention in connection with specific apparatus, it is to be clearly understood that this description is made only by way of example, and not as a limitation to the scope of the invention.

What is claimed is:

1. A hydraulic system for use with a farm implement having a frame and tool, including:

a. a hydraulic cylinder for mounting to the frame and having a main piston to effectuate the raising and lowering of said tool and a floating stop piston for limiting the travel of said main piston within the cylinder, the position of said stop piston being adjustable by admitting and draining fluid from a region of said cylinder;

b. depth sensing means for sensing the actual depth of the implement tool and providing a depth signal indicative thereof; and c. piston position control means for receiving said depth signal and controlling the positions of said piston, said piston position control means including:

a. means adjustable to provide a first signal corresponding to the desired minimum depth penetration of said implement tool and a second signal corresponding to the desired maximum depth penetration of said implement tool;

b. comparator means receiving said depth signal and said first and second signals for causing the position of said floating stop piston to be adjusted, and thereby the position of said main piston, to lower said implement tool when said depth signal indicates that the tool is higher than the desired minimum depth penetration and to raise said implement tool when said depth signal indicates that the tool is lower than the desired maximum depth penetration; and c. jog control means operative when activated to cause said main piston to travel in said cylinder to raise the implement tool without substantially altering the position of said stop piston.

2. A hydraulic system according to claim 1 wherein said depth sensing means senses the depth of the implement through a plurality of independent sensors each producing a signal indicative of the depth of said implement tool and wherein said depth sensing means includes means responsive to said independent signals to produce said depth signal, which is representative of said independent signals.

3. A hydraulic system according to claim 1 wherein said depth sensing means includes means for monitoring each of said independent signals to determine if any one of said signals is erroneous, and wherein said depth sensing means includes means for disregarding an erroneous signal so that it does not affect said representative depth signal.

4. A hydraulic system according to claim 3 further including a display panel means for mounting in the tractor cab and including a first operator visible display responsive to said depth signal to indicate the depth of penetration of the implement tool.

5. A hydraulic system according to claim 4 wherein said display panel means further includes a second operator visible display responsive to said first and second desired depth signals to indicate the desired depth limits selected.

6. A hydraulic system according to claim 5 wherein said visible depth limit display is caused to blink when said depth signal is outside the desired range specified by said limit signals.

7. A hydraulic system according to claim 1 wherein said comparator means causes said implement tool to be moved back to a point substantially center of the desired preset depth limits in response to a deviation of said tool outside of the desired preset depth limits.

* * * * *